US006029831A

United States Patent [19]

Miller

[11] Patent Number: 6,029,831

[45] Date of Patent: Feb. 29, 2000

[54] NON-RACKING PANEL DISPLAY DEVICE

[76] Inventor: Melvin M. Miller, 2412 Ashwood Dr., Bloomington, Ind. 47401

[21] Appl. No.: 09/015,776

[22] Filed: Jan. 29, 1998

Related U.S. Application Data

[63] Continuation-in-part of application No. 08/759,138, Dec. 2, 1996, abandoned, which is a continuation-in-part of application No. 08/399,236, Mar. 6, 1995, Pat. No. 5,687,859.

[51] Int. Cl.[7] ..... A47B 43/00

[52] U.S. Cl. ..... 211/189; 211/182; 52/584.1

[58] Field of Search ..... 211/189, 182; 52/584.1, 585.1, 582.1, 582.2

[56] References Cited

U.S. PATENT DOCUMENTS

| | | | |
|---|---|---|---|
| 2,647,287 | 8/1953 | Jones | 20/4 |
| 2,970,677 | 2/1961 | Springs | 189/34 |
| 3,087,586 | 4/1963 | Gray | 189/34 |
| 3,766,696 | 10/1973 | Totoonchie | 52/241 |
| 4,204,375 | 5/1980 | Goud | 52/239 |
| 4,381,632 | 5/1983 | Geitner | 52/262 |
| 4,505,085 | 3/1985 | Oliver | 52/582 |
| 4,625,477 | 12/1986 | Johnstonbaugh | 52/127.9 |
| 4,716,692 | 1/1988 | Harper et al. | 52/36 |
| 4,778,486 | 10/1988 | Chenel | 52/239 |
| 4,926,609 | 5/1990 | Arico | 52/582 |
| 4,989,386 | 2/1991 | Collis | 52/584 |
| 5,004,371 | 4/1991 | Sorensen | 403/327 |
| 5,038,535 | 8/1991 | Van Praag | 52/127.9 |
| 5,687,859 | 11/1997 | Miller | 211/189 |

*Primary Examiner*—Timothy V. Eley
*Assistant Examiner*—Willie Berry, Jr.
*Attorney, Agent, or Firm*—Donald R. Bahr

[57] ABSTRACT

This invention is concerned with a panel device which is useful in the display and furniture arts, the panel device is formed from a plurality of panels which are securely locked into a three axis relationship with each other, the vertical edges of the individual panels incorporate undercut grooves, the vertical edges of the individual panels are provided with opposing locking lugs and a an elongated locking rod which retains the panels in relation to each other, the panel device may be readily converted from a set up to a flat stance for storage, in one embodiment at least the vertical edges of the individual display panels are provided with undercut H shaped channels that are secured in grooves that are routed into the edges of the panels, these H shaped channels further interact with the locking lugs and the elongated locking rod. The locking lugs may be placed on an intermediate extrusion which has planar sides which are angularly disposed to each other thereby allowing the panels to be attached to each other in an angular relationship.

27 Claims, 8 Drawing Sheets

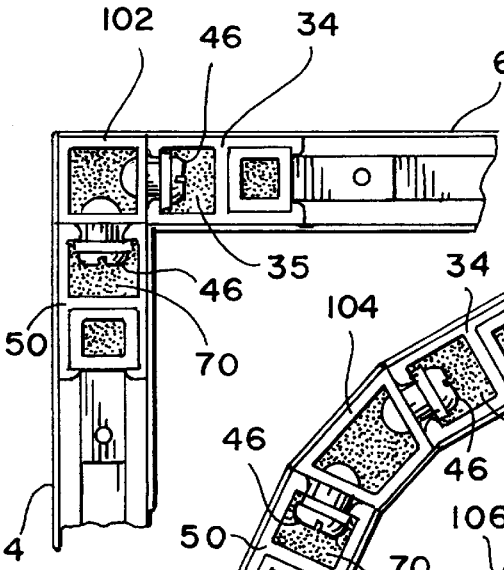
FIG. 7
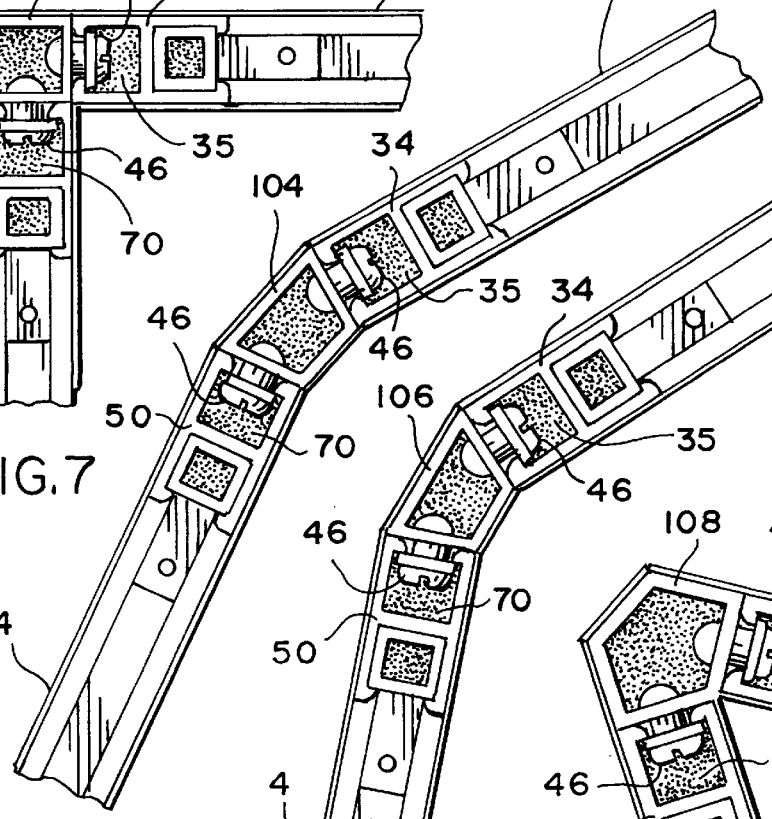
FIG. 7a
FIG. 7b
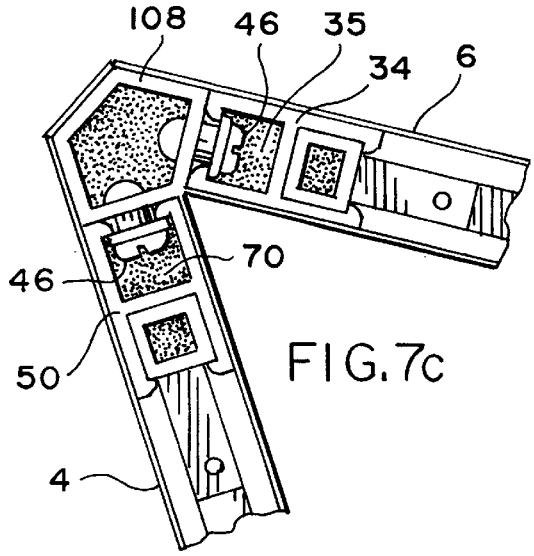
FIG. 7c

NON-RACKING PANEL DISPLAY DEVICE

RELATED APPLICATION

This application is a continuation in part application of application Ser. No. 08/759,138 filed Dec. 2, 1996 now abandoned as of Sept. 19, 1998 which is a continuation in part explanation of Ser. No. 08/399,236 filed Mar. 6, 1995 now U.S. Pat. No. 5,687,859.

FIELD OF THE INVENTION

This invention is concerned with portable flexible, panel devices which can be used to display information at trade shows and conventions. The panel device of this invention is also useful in the furniture arts. Panel devices as may be used at trade shows or conventions are of two principle types, those being the large bulky type and the portable type. This invention is concerned with the portable type of device. Portable display devices have become very popular in recent years for utilization at regional trade shows and conventions, these portable display devices, when assembled, present a nice impression and have a very high display surface to weight ratio. Further, these portable display devices are advantageous in that they can be quickly and easily assembled and disassembled without tools by one person. In contrast, the large bulky display devices as mentioned above are very heavy and hence have a low display surface to weight ratio. Further, these display devices can be assembled and dissembled only with great difficulty by extra workmen at great expense.

DESCRIPTION OF THE BACKGROUND ART

The subject invention is useful in connection with portable display devices wherein a plurality of display panels may be combined to form a composite portable display device. Further the invention is concerned with portable displays wherein the panels may be located in angular relationship with each other. This invention is also concerned with display devices wherein the supporting structure is covered with the same fabric or plastic laminate that is used to cover the display panels so that the total display presents a uniform surface.

Planar display devices are very common in the prior art. Typically, these prior art display devices comprise a plurality of segments which are formed from plurality of interconnected panel sections. Because these segments are formed from interconnected panel sections the panel sections become somewhat heavy and difficult to assemble into a finished display device. The weight of the display segments in particularly important when the assembly of the finished display device must be effected by a woman. This invention is concerned with display devices wherein single panel sections are joined one to each other to form a finished multi-panel display device.

With all light weight panel devices there is a problem of holding the individual panel sections in relation to each other. This is particularly true of the joints which allow the individual components to be broken down. Naturally the more components that are used to form a display device the more problems one has in retaining these component panels in fixed relationship with each other.

Referring to FIG. 1 which shows X, Y, and Z, axis the panel attachment systems of the prior art do an acceptable job of retaining the various panel segments in relation to each other in the X and Z axis. Retaining the panels in relation to each other and preventing movement in the Y axis has been a problem. The movement of panel segments in relation to each other in the Y axis is analogous to the vertical shearing of the panels one past each other. This shearing in turn produces an undesirable "saw tooth effect" at the top horizontal edge of a structure.

This invention is concerned with a panel locking system where individual panels can be locked into a secure rigid relationship with each other in the X, Y, and Z axis in order to form a strong, stable display device. In accordance with this invention a display device is formed by the locking of a plurality of panels in an up and down, left to right and forward and backward relationship. This secure locking of the individual panels allows the display device to be used on uneven surfaces for example, an uneven concrete floor of a convention center.

The locking of a plurality of individual panels to form a display device in accordance with this invention can be effected without tools and with only the use of finger pressure. Further. In this invention all the components of the display are uniformly covered with the same fabric or other sheet material.

Accordingly, it is an object of this invention to provide a panel device wherein the display panels and the supporting hardware are covered with the same fabric or other sheet material.

It is a further object of this invention to provide a system wherein a plurality of individual panels can be readily and easily assembled and locked into a three axis relationship with each other in order to form a display device.

Likewise, it is an object of this invention to provide a display device which can be readily converted from a set up stance to a flat stance for shipping.

Also it is an object of this invention to provide a display device wherein panels can be secured at right angles to each other in a three axis relationship.

It is also an object of this invention to provide a portable display device wherein individual panels can be replaced or subtracted from the display device to allow reconfiguration of the display at will. It is also an object of this invention to provide a portable display device which allows for the easy replacement of damaged panel sections.

It is also an object of this invention to provide a means wherein a plurality of individual panels can be locked into a secure three axis relationship with each other to form a display device without the use of tools and can be unlocked for easy disassembly with only the use of finger pressure.

Another object of this invention is to provide a display device wherein the individual panels do not rack one past another in a vertical plane.

Still another object of this invention is to provide a display device which can be used on an uneven surface.

Also, it is an object of this invention to provide a display device which can be assembled from individual panels by a person of small stature for example a woman.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages as well as a fuller understanding of this invention may be had by referring to the summary and detailed description of the preferred embodiment of the invention in addition to the scope of the invention as defined by the claims taken in conjunction with the accompanying drawings.

SUMMARY OF THE INVENTION

The invention is defined by the appended claims with the specific embodiments being shown in the attached drawings. For the purposes of summarizing the invention, the invention may be described as a system where a plurality of individual panels can be readily and easily assembled into a multi-panel display device.

This invention provides a means wherein the individual panels can be rigidly secured one to another in a three axis relationship by use of a locking rod the axis of which is generally parallel with the vertical edges of the panels.

The invention utilizes a plurality of panels having vertical edges which incorporate undercut channels. These undercut channels may be further provided with opposing guide fingers which assist in locating and securing a pair of opposing panels in X and Z planes, as is illustrated in FIG. 1.

One or both vertical edges of one of the panels is provided with locking lugs which interact with the cut outs of an adjacent panel.

The relationship of adjacent panels in three planes is further secured with a locking rod that interacts with a locking lug or an adjacent panels so as to further secure one panel to another in sequence in relationship with each other. When the locking rod is disengaged the opposing adjacent panels can be disassembled.

When a plurality of individual panels are assembled together a display device results. Multiple tiers of assembled panel segments can be placed one on another to form a composite display device.

Because the panel device of this invention is formed from a plurality of individual panel sections it can be readily converted from a set up stance to a planar stance. The ability to convert panels form a set up stance to a planar stance is very useful, as in the planar stance the panel can be readily stored for shipment.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art, that the conception and the specific embodiment disclosed herein may be readily utilized as a basis for modifying or designing other display devices for carrying out the purposes of the present invention. Further it should also be realized by those skilled in the art that such equivalent display devices do not depart from the spirit and scope of the invention as set forth in the appended claims.

DESCRIPTION OF THE DRAWINGS

FIGS. 7, 7*a*, 7*b*, and 7*c* is a top plan view showing alternate structures wherein the panels can be angularly disposed.

DESCRIPTION OF THE PREFERRED EMBODIMENT

The subject invention relates to a panel device which is formed from a plurality of panels which are secured in relationship to each other.

Figure 1:
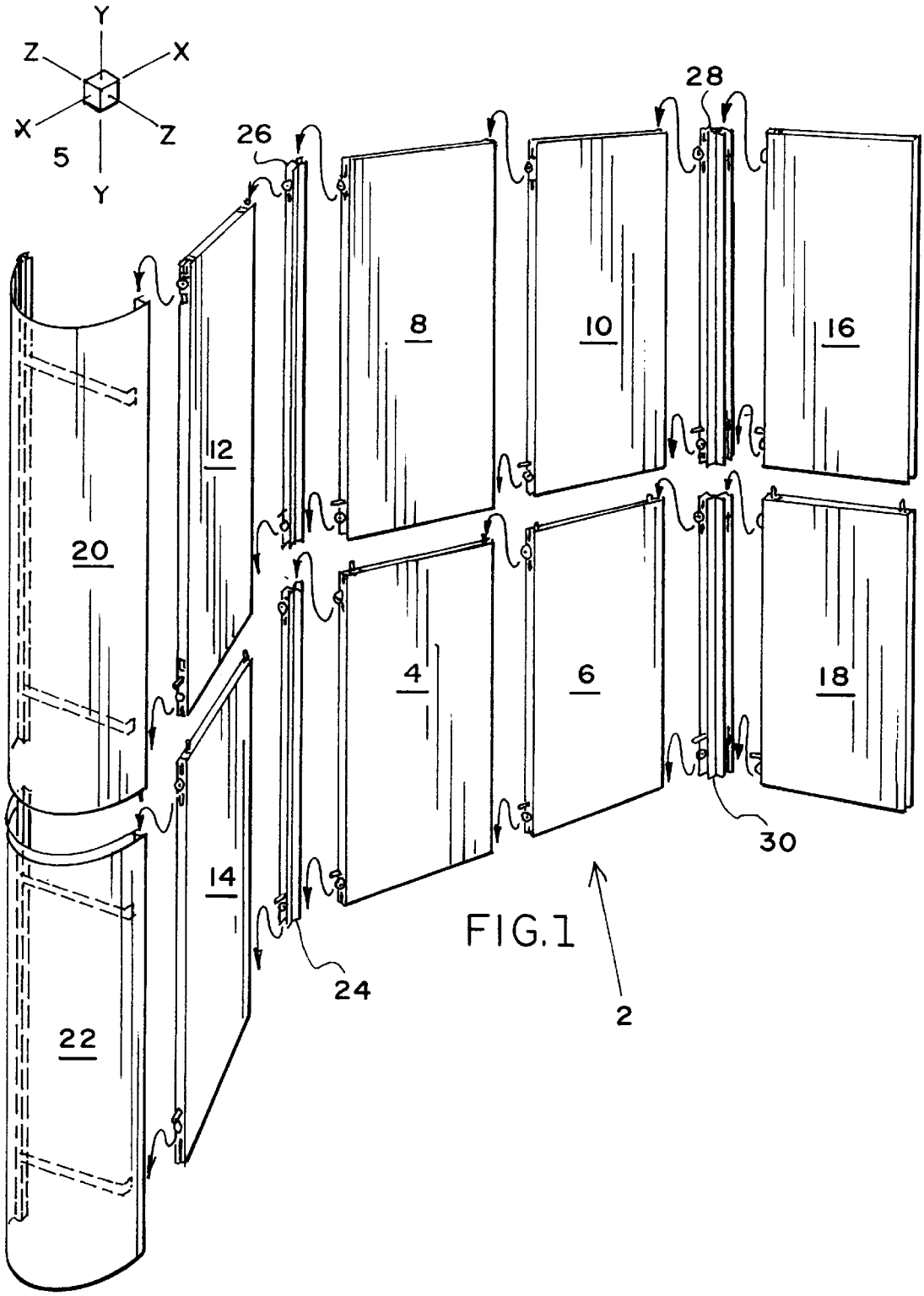
FIG. 1 is a perspective view showing a display device of this invention showing the individual components thereof.

Referring to FIG. 1 it can be seen that the panel device 2 of this invention comprises a plurality of planar panel; 4,6,8,10,12,14,16 and 18 which are interconnected. The interconnecting of panels 8 to 12, 4 to 14, 10 to 16 and 6 to 18 is via a hinge members 24,26,28 and 30 also shown. FIG. 1 also shows the connection of curved panels 20 and 22 to planar panels 12 and 14.

FIG. 1 also incorporates an X, Y and Z axis legend 5, which comprises a reference for the discussion herein. The X axis is the horizontal axis which is parallel to the plane of panels 4,6,8 and 10. The Y axis is the vertical axis which is parallel with the plane of panels 4,6,8 and 10. Lastly the Z axis is the axis which is at right angles to the plane of panels 4,6,8 and 10. That is the X axis is left to right, the Y axis is up and down and the Z axis is in and out.

This invention is particularly concerned with preventing the individual panels from racking one past another in the Y axis. This racking could also be described as a vertical shear of one panel past another.

The prevention of the racking of one panel past another is undesirable as when one panel racks past another the overall display device presents a distorted horizontal upper edge which is undesirable in both the furniture and display arts.

As is mentioned here in above, the subject device is particularly useful in the portable display arts. It should be noted, however, that the panel device of this invention is also useful in the furniture arts. The subject panel device can be fabricated in such a size that it can be used for example, as a room divider, office separator, privacy screen or noise barrier. In the furniture arts, the panel device of this invention is particularly useful in that the various panels can be angularly disposed in relation to each other.

The details of how vertical panels 4 and 6 are joined together is shown in FIGS. 2 to 5 this joining may be in a planar or right angle relationship. For purposes of description panels 4 and 6 are taken as representative adjacent panels out of FIG. 1. Further the hinge members 24,26,28 and 30 and the curved panels 20 and 22 are interconnected to planar panels in the same manner as is described in connection with panels 4 and 6 as is illustrated in FIGS. 2 to 5.

Figure 2:
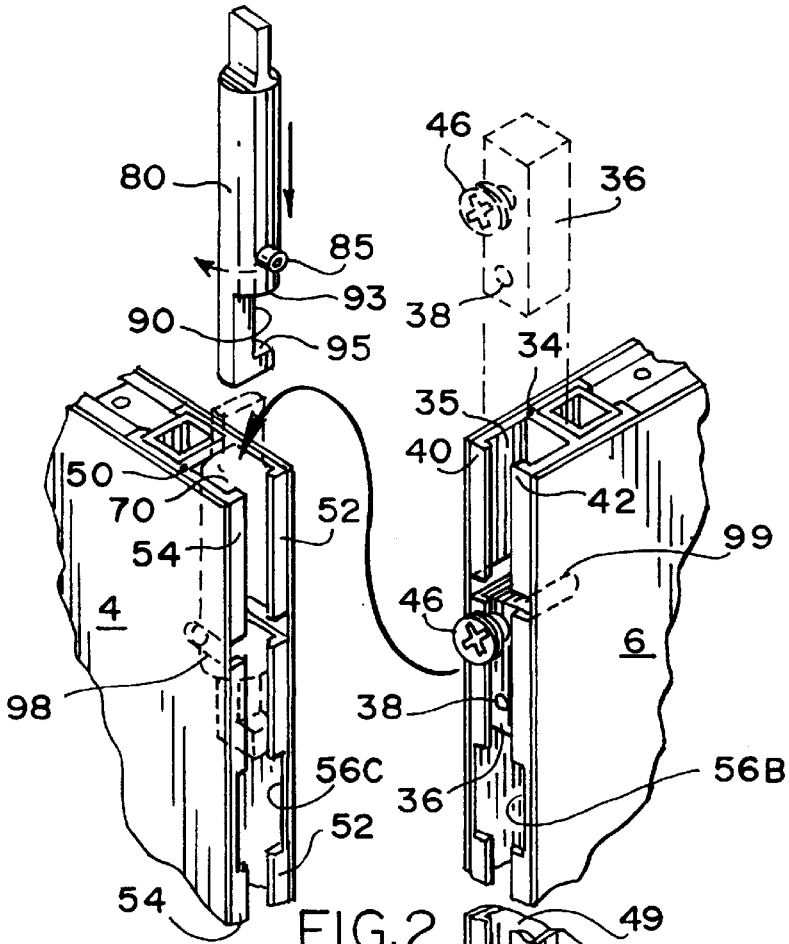
FIG. 2 is a fragmentary perspective view, partly in section, of lower segments of display panels in accordance with this invention showing the assembly of the parts thereof some parts being shown in phantom lines.

Referring to FIG. 2 it can be seen that panel 6 has an H shaped extrusion 34 integral therewith, a locking block 36 is positioned in the outer compartment 35 of H extrusion 34. Locking block 36 is retained in H extrusion 34 by screw 38 which biases locking block 36 against lips 40 and 42 of H shaped extrusion 34.

Figure 3:
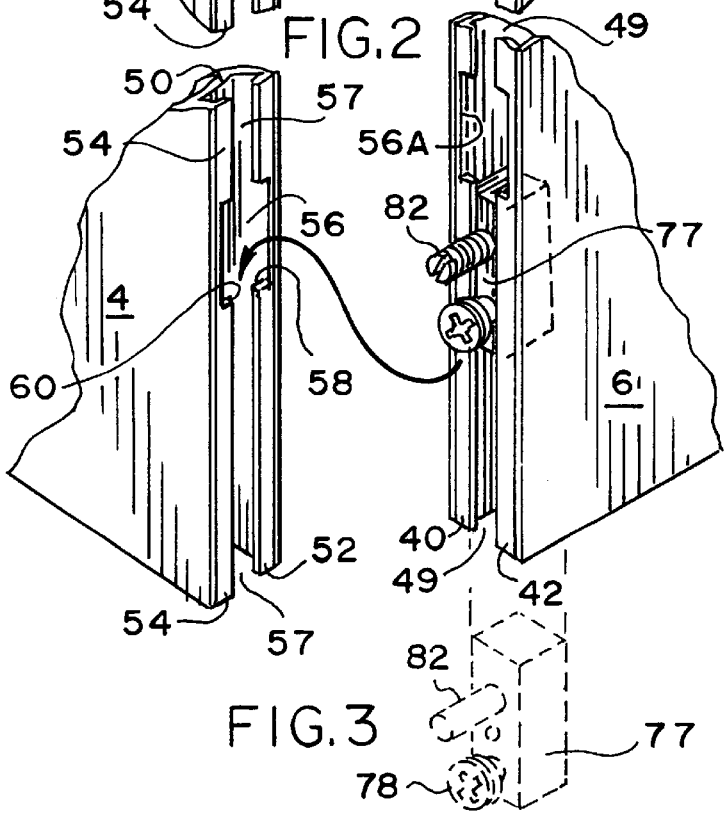
FIG. 3 is a fragmentary perspective view, partially in section, of an upper segments of display panels in accordance with this invention showing the assembly of the parts thereof some parts being shown in phantom lines.

Panel 4 also has in H shaped extrusion 50 integral therewith. The outer compartment 70 of H shaped extrusion 50 further incorporated a pair of opposing lips 52 and 54 as is shown in FIGS. 2 and 3. Lips 52 and 54 are relieved to form aperture 56. As a result of the formation of aperture 56 locking tabs 58 and 60 are formed.

As is seen in FIG. 3 a second locking block 77 may be positioned in outer compartment 35 of H shaped extrusion 34. Locking block 77 is retained in compartment 35 by using locking screw 83 to bias locking block 77 against the inner edge of lips 40 and 42. The head of locking screw 83 aids in the alignment of panel 6 with panel 4. Locking block 77 is positioned in compartment 35 intermediate of the terminal ends of H shaped extrusion 34. Slot 49 allows locking lugs 46 and 78 and the head of locking screw to move in compartment 35 of H shaped extrusion 34.

As is discussed above locking block 77 further incorporates guide pin 82 which aids in the alignment of panels 4 and 6 during assembly. It is understood by one skilled in the art that locking block 36 may also incorporate a guide pin such as guide pin 82 to aid in the alignment of the edges of panels 4 and 6 during assembly.

In accordance with this invention the use of guide pins such as guide pin 82 is optional.

Locking blocks 36 and 77 further incorporate locking lugs 46 and 78 which are adapted to engage and upper and lower terminal end of H shaped extrusion 50.

In assembly, panels 4 and 6 are positioned roughly in a planar relationship with each other, panel 6 being slightly above panel 4. Locking lug 46 is then positioned in compartment 50. If present guide pins 82 are positioned in slot 57. On the lower side of panels 4 and 6 locking lug 78 is positioned in aperture 56. H shaped extrusions 34 and 50 are further provided with additional apertures 56*a,* 56*b,* and 56*c*. These additional apertures are used when the composite display device is reconfigurated by disassembly thereby allowing panels 4 and 6 to be reversed.

When this repositioning is effected panels 4 and 6 may be joined via the following described sequence, pane 6 is moved downwardly in relation to panel 4 thereby causing locking lug 46 to be secured in slot 57 and biased against lips 52 and 54. In turn locking lug 78 moves down into slot 57 and is likewise biased against lips 52 and 54

At this stage of the assembly panels 4 and 6 are secured in relationship to each other in the x and z planes as per the legend 5 of FIG. 1. In order to prevent panels 4 and 6 from racking vertically parallel to each other in the y axis locking rod 80 is utilized. Locking rod 80 is inserted into compartment 70 of H shaped extrusion 50 and rotated approximately one forth turn in a clockwise direction. The operation of locking rod 80 will be described in greater detail herein below.

Figures 4, 5, 6:
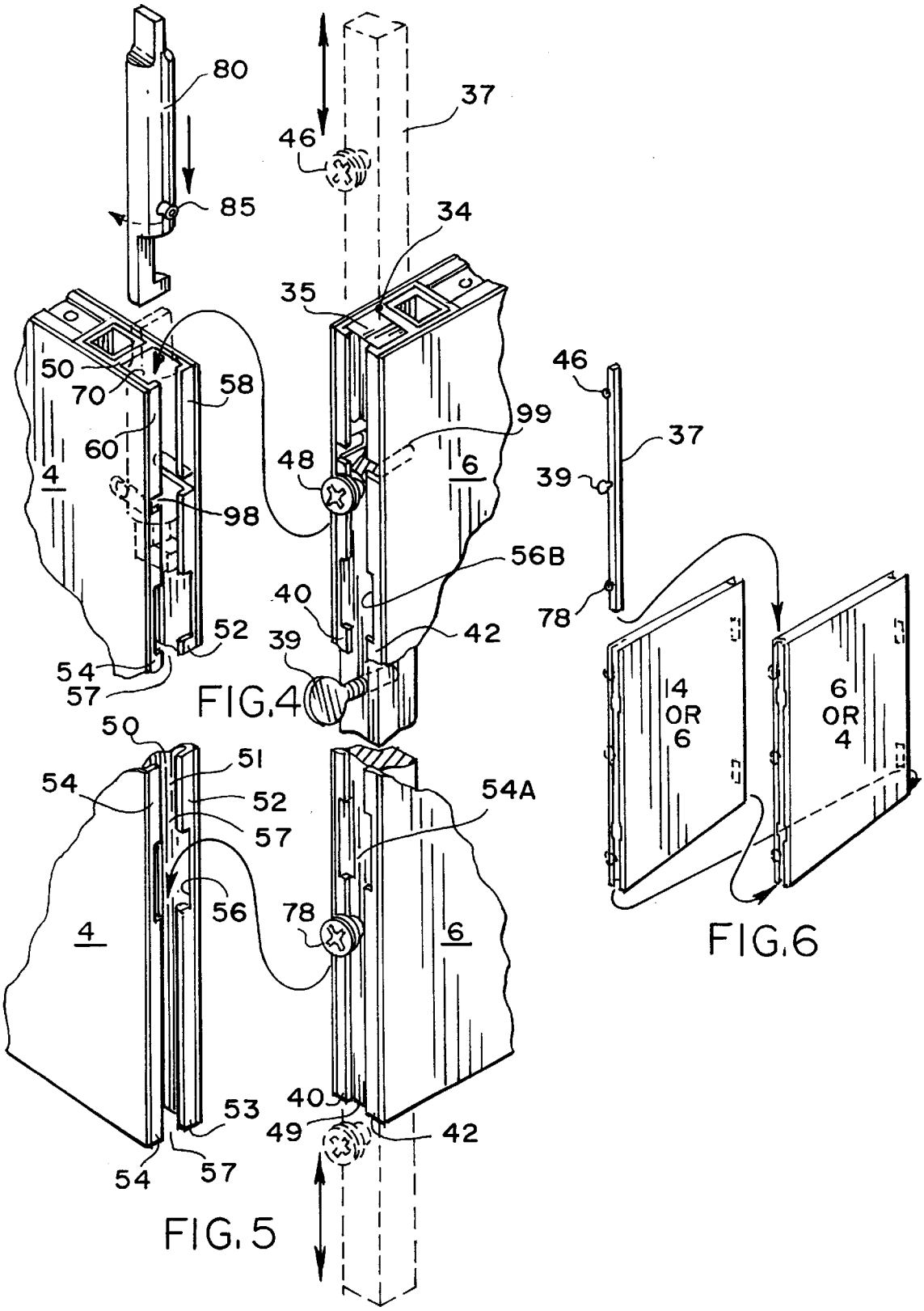
FIG. 4 is a fragmentary perspective, partially in section of an alternate upper segment of a display panel of this invention showing the assembly of the parts thereof same parts being shown in phantom lines.
FIG. 5 is a right angle fragmentary perspective, partially in section of a lower segment of a display panel of this invention showing the assembly of the parts thereof some parts being shown in phantom lines.
FIG. 6 is a perspective view showing how the panels of the alternate structure of FIGS. 4 and 5 can be readily reversed.

FIGS. 4, 5, and 6 further show an alternate structure wherein both locking lugs 46 and 78 are positioned on a unitary rod 37 which is secured in compartment 35 of H shaped extrusion 34 via a thumb screw 39 which is threaded into unitary rod 37. As can be seen in this embodiment the component parts of panels 4 and 6 are identical to those shown in FIGS. 2 and 3 however locking blocks 36 and 77 have been replaced by a single unitary rod 37.

The use of a unitary rod as illustrates aids in the assemble of panel 6. In the structure as shown rod 37 after being placed in H shaped extrusion 34 is secured in place by tightning thumb screw 39 thereby causing rod 37 to be biased against lips 40 and 42 of H shaped extrusion 34. Once this tightning is complete the axis of the head of wing bolt 39 is positioned parallel with the axis of slot 57 thereby allowing the head of thumb screw 39 to be positioned in slot 57 of panel 4 thereby aiding in the placement of locking lugs 46 and 78 in compartment 70 and aperture 56.

Figure 8:
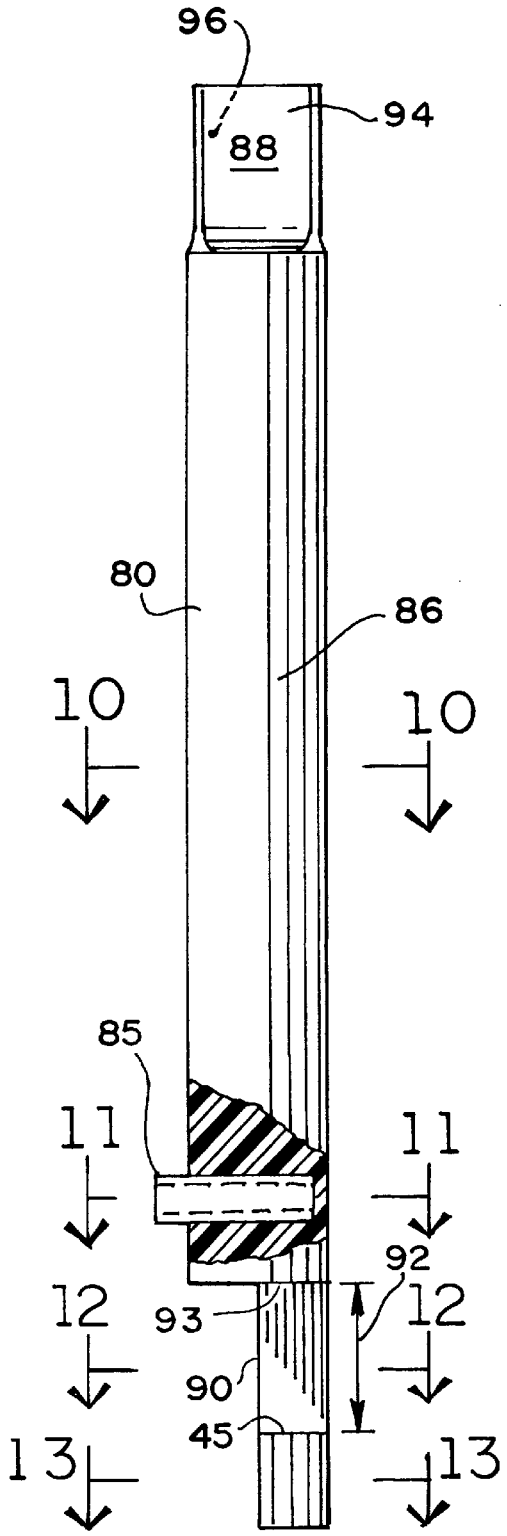
FIG. 8 is a side view of the locking rod as used in this invention.
Figure 9:
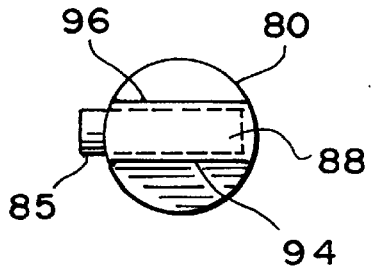
FIG. 9 is a top plan view of the locking rod.

Referring to FIG. 8 it can be seen that locking rod 80 has a main body section 86, a finger gripping section 88 a U shaped cut out section 90, the length of a U shaped cut out 90 as is defined by arrow 92 is approximately the same size as the diameter of the head of locking lug 46. Further attached to the lower part of locking rod 80 is a locking pin 85. Gripping section 88 comprises a pair of opposing flats 94 and 96. These flats provide a convenient area whereby locking rod may be gripped by opposing human fingers and rotated.

Figure 10:
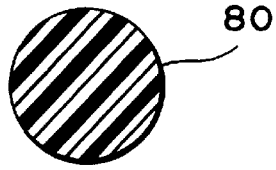
FIG. 10 is a sectional view through line 10—10 of FIG. 8 showing a cross section of the locking rod.
Figure 11:
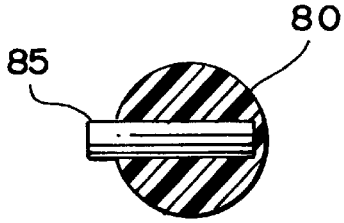
FIG. 11 is a sectional view through line 11—11 of FIG. 8 showing a cross section of the locking rod.
Figure 12:
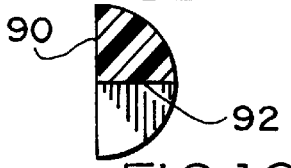
FIG. 12 is a sectional view through line 12—12 of FIG. 8 showing a cross section of the locking rod.
Figure 13:
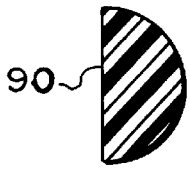
FIG. 13 is a sectional view through line 13—13 of FIG. 8 showing a cross section of the locking rod.

As can be seen from FIG. 10 main body section 86 is cylindrical.

From FIG. 2 it can be seen that locking rod 80 is inserted into compartment 70 and rotated clockwise. This rotation is effected by finger pressure which is applied to gripping section 88.

When this clockwise rotation is effected locking pin 85 engages slot 98 which is integral with H shaped extrusion 50. When locking pin 85 engages slot 98 locking rod 80 is secured into compartment 70. Simultaneously the securing of panel 4 and 6 to each other is effected when locking rod 80 is thus rotated clockwise approximately 90 degrees thereby causing upper and lower edges 93 and 95 of cut out 90 engage the upper and lower edges of the head of locking lug 46 which secures locking lug 46 in U shaped cut out 90 and in turn panel 4 is secured to panel 6 in a non racking fashion. Panel 6 can not rack against panel 4 in the direction of axis Y of legend 5 as both the upper and lower sides of the head of locking lug 46 are secured in U shaped cut out 90 of locking rod 80. Upper and lower edges 93 and 95 of cut out 90 may be beveled so as to form cam surface which aid in allowing cut out 90 to engage locking lug 46.

To disengage panel 4 from panel 6 locking rod 80 is rotated counterclockwise approximately 90 degrees thereby causing locking pin 85 to disengage from slot 98 and U shaped cut out 90 to disengage from the head of locking lug 46. Locking rod 80 can then be lifted up and out of compartment 70 of H shaped extrusion 50. Panel 6 can then be lifted up until locking lug 46 is free of compartment 70 at which time panel 6 can be moved away from panel 4 in a plane which is parallel with axis X of legend 5. At this point panels 4 and 6 are free of each other and can be stored for shipment if so desired.

H shaped extrusion 34 is further provided with a slot 99 which would engage locking pin 85 if panels 4 and 6 were reversed and locking rod 80 was inserted into aperture 35 of H shaped extrusion 34.

As can be seen from the drawings and is discussed above locking rod 80 is a separate part from panels 4 and 6 and as such locking rod 80 can be lost. In the absence of locking rod 80 it is not possible to secure panels 4 and 6 to each other. Hence it is desirable to have the locking rod secured into the compartment in which it is placed.

Figure 14:
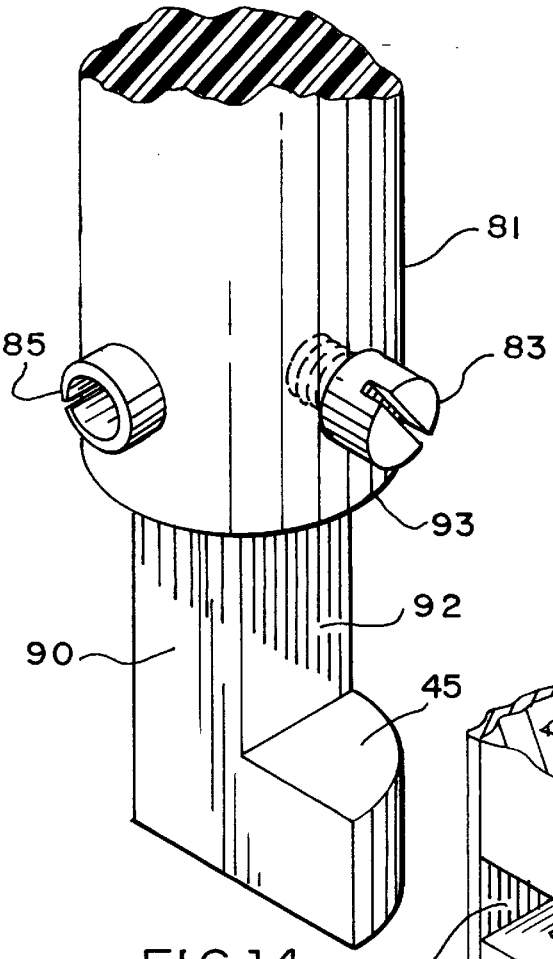
FIG. 14 is a perspective view showing alternate of the locking rod assembly.
Figure 15:
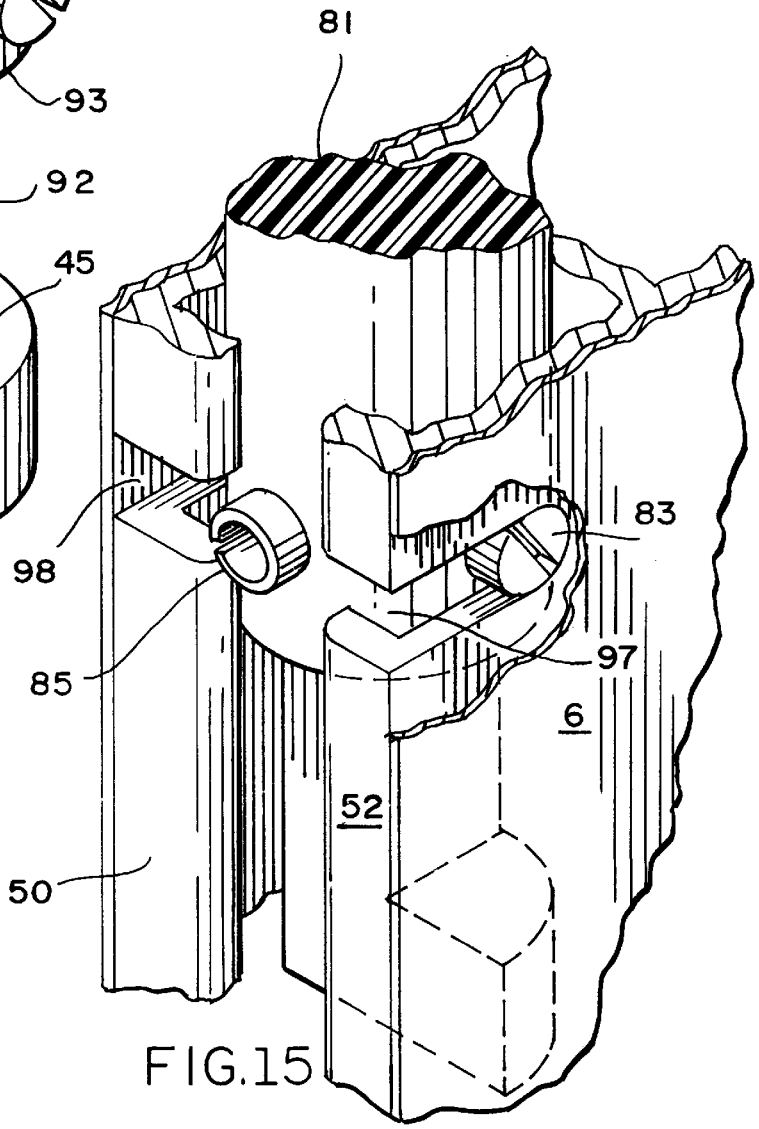
FIG. 15 is a cut away perspective view showing the alternate embodiment of the locking rod of FIG. 14 in place.
Figure 16:
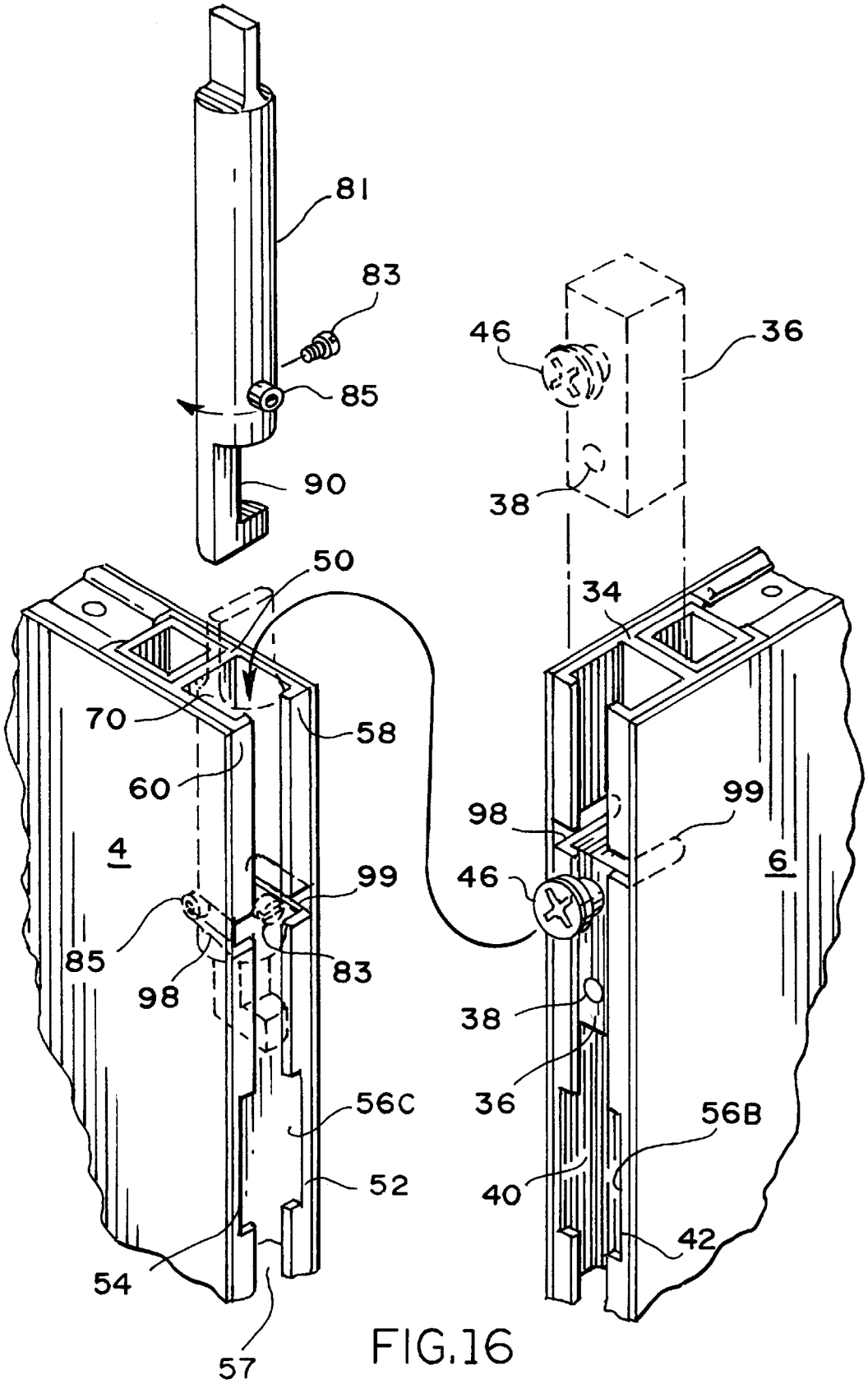
FIG. 16 shows the placement of the locking rod of FIG. 14 into a panel.

FIGS. 14,15 and 16 illustrate another embodiment for a locking rod. In this instance locking rod 81 is provided with a second locking screw 83 which is spaced apart from locking pin 85 approximately 90 degree. In assembly locking rod 81 is inserted into compartment 70 of H shaped extrusion 50 without locking screw 83 in place. After locking rod 81 is in place it is rotated approximately 90 degrees causing locking screw 85 to engage slot 98. Locking screw 83 is then inserted into a pre drilled aperture which is provided in locking rod 81. With locking screw 83 in place locking rod 81 is secured in H shaped extrusion 50 and hence to panel 4. This securing is effected as if locking rod 81 is turned clockwise locking pin 85 engages slot 98 which is cut into lip 54 of H shaped extrusion 50. Conversely if locking pin 81 is rotated counter clockwise to allow the disengagement of panels 4 and 6 from each other as described above locking screw 83 engage, slot 97 in lip 52 of H shaped extrusion 50.

As can be seen no matter which way locking rod 81 is rotated locking rod 81 is secured in compartment 70 of H shaped extrusion 50. This securing of locking rod 81 in compartment 70 of H shaped extrusion 50 prevents locking rod 81 from becoming a loose piece which can be lost.

While locking screw 83 is shown as a screw it is understood that it could also be for example a solid rod or a roll pin.

Figure 17:
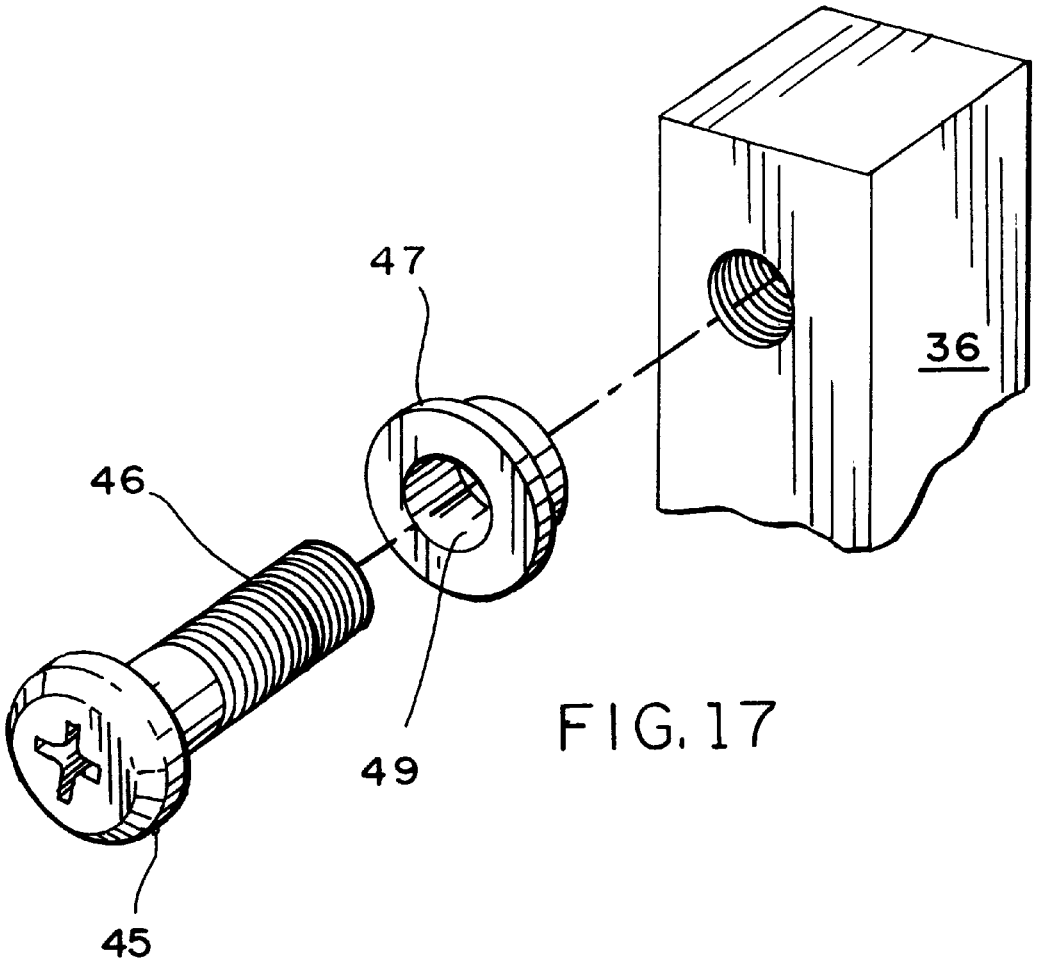
FIG. 17 shows further details of the locking lugs

As can be seen from an examination of FIGS. 2,3, and 6 locking lugs 46 and 78 are held in place by a screw. Other equivalent fasteners may likewise be used. The outer extremity of the locking lugs as illustrated are of larger diameter as compared to the body portion 75 thereof. As is best illustrated in FIG. 17 this structure forms an undercut which allows the locking lugs to be securely biased in the opposing H shaped channel thereby securing opposing display panels 4 and 6 together. Further the over sized head allows lug 46 to engage U shaped cut out 90 of either locking rods 80 and 81 as is discussed above.

In the embodiments as illustrated and described above both locking lugs are located on panel 6. It should be noted however that in an alternate embodiment locking lugs 46 and 76 may be located one on each of panels 4 and 6.

FIG. 17 illustrated the component parts of locking lug 46 and how it is secured into locking block 36. Locking lug 46 comprises a screw 45 and a flange 47 which further incorporates an aperture 49. When screw 45 is pressed through aperture 49 and screw into locking block 36 flange 47 is secured to locking block 36. By varying the degree to which screw 45 is tightened flange 47 can be either secured to locking block 36 or left free to rotate. This rotation is desirable as it allows the flange 47 to rotate in for example compartment 50 thereby easing this assembly operation.

The description alone relates to a display device wherein the panels are secured to each other in a planar relationship. In some instances it may be desirable to secure the panels in an angular relationship. In this regard FIGS. 7,7*a*,7*b* and 7*c* illustrate how by the use of an intermediate extrusion such as extrusions 102,104,106 and 108 any desired angular relationship between panels 4 and 6 can be achieved.

In these structures locking lugs 46 are attached to intermediate extrusions 102,104,106 and 108. It is understood that a pair of locking lugs are utilized. Using these locking lugs panels 4 and 6 are attached to intermediate extrusions 102,104,106 and 108 in the manner described above in connection with FIGS. 2 and 3. To secure panels 4 and 6 to intermediate extrusions 102,104,106 and 108 locking rods are then inserted into aperture 35 and 70 of H shaped extrusions 34 and 50 in a manner which is identical to that described above in connection with FIGS. 2 and 3.

The above description and drawings are illustrative of modifications that can be made without departing from the present invention, the scope of which is to be limited only by the following claims.

What is claimed is:

1. A panel display device having a plurality of vertical display panels wherein one or more pairs of adjacent vertical panels are attached to each other by a non-racking attachment system which comprises:

a. at least two male locking lugs which are located on the vertical edge of one or more display panels approximate the vertical terminal edges thereof;

b. female apertures which are located on the vertical edge of an adjacent display panel opposite said male locking lugs wherein said female apertures are integral with an elongated compartment which is integral with the vertical edge of said adjacent display panel, c. a locking rod having a first and second ends the first end being adapted to being gripped and rotated, said second end being adapted to engage the head of an adjacent locking lug, the locking rod being positioned in said elongated compartment of the adjacent display panel.

2. The panel display device of claim 1 wherein the vertical edges of adjacent pairs of both vertical display panels incorporate elongated channels in which are located the male locking lugs, the female apertures and said locking rod.

3. The panel display device of claim 2 wherein said channels are H shaped and the outer edges of said H shaped channels incorporate a pair of opposing lips which define elongated compartments.

4. The panel display device of claim 3 wherein said male locking lugs are positioned on blocks which are secured in the defined compartments of said H shaped channels.

5. The panel display device of claim 4 wherein the end of at least one of said male locking lug define an undercut which is adapted to engage the opposing channel.

6. The panel device of claim 2 wherein said male locking lugs are integral with bases which are secured in the elongated channels which in turn are secured to opposing vertical edges of said display panels.

7. The panel display device of claim 2 wherein the end of at least one of said male locking lugs define an undercut which is adapted to engage the opposing channel and the second end of the locking rod.

8. The panel display device of claim 3 wherein the end of at least one of said male locking lugs define an undercut which is adapted to engage the opposing channel and the second end of the locking rod.

9. The panel device of claim 3 wherein said male locking lugs are integral with bases which are secured in said H shaped channels which in turn are secured to opposing vertical edges of said display panels.

10. The panel device of claim 4 wherein said male locking lugs are integral with bases which are secured in said H shaped channels which in turn are secured to opposing vertical edges of said display panels.

11. The panel display device of claim 1 wherein the end of at least one of said male locking lugs define an undercut which is adapted to engage the opposing channel and the second end of the locking rod.

12. The panel device of claim 11 wherein said male locking lugs are integral with bases which are secured in channels which in turn are secured to opposing vertical edges of said display panels.

13. The panel device of claim 1 wherein said male locking lugs are integral with bases which are secured in channels which in turn are secured to opposing vertical edges of said display panels.

14. A panel display device comprising:

a. a plurality of vertical display panels having vertical edges, which incorporate hollow channels, one or more pairs of said display panels being attached to each at three vertical edges;

b. a pair of male locking lugs which are located on the vertical edge of one or more display panels approximate the vertical terminal edges thereof;

c. a pair of female apertures which are integral with said hollow channels which are located on the vertical edge of an adjacent display panel opposite said male locking lugs and approximate the vertical terminal edges thereof, said locking lugs being locked into said apertures;

d. a locking rod which is positioned in said hollow channel on the vertical edge of a display panel opposite said locking lugs wherein when the locking rod is rotated it engages an opposing locking lug.

15. The panel display device of claim 14 wherein the hollow channels are H shaped having inner and outer compartments the inner compartment engaging the display panel, the outer compartment having a pair of lips, in which are defined said female apertures and in which are positioned the locking lugs of an adjacent panel.

16. The panel device of claim 15 wherein the locking lugs are further secured to locking blocks which are in turn secured in the outer compartment.

17. The panel device of claim 16 wherein the locking rod incorporates a pin which engages a cut in the hollow channel, in which it is positioned and a cam surface which engages the locking lug.

18. The panel device of claim 17 wherein the locking rod incorporates a pin and a locking screw which are disposed at approximately 90 degrees to each other wherein when the locking rod is rotated in one direction the pin engages a slot in the channel in which it is located and wherein the locking rod is rotated in the opposite direction the locking screw engages a second slot in the channel in which it is located, so as to secure the locking rod in the channel in which it is located.

19. The panel device of claim 15 wherein the locking rod incorporates a pin and a locking screw which are disposed at approximately 90 degrees to each other wherein when the locking rod is rotated in one direction the pin engages a slot in the channel in which it is located and wherein the locking rod is rotated in the opposite direction the locking screw engages a second slot in the channel in which it is located, so as to secure the locking rod in the channel in which it is located.

20. The panel device of claim 15 wherein the locking rod incorporates a pin which engages a cut in the hollow channel, in which it is positioned and a cam surface which engages the locking lug.

21. The panel device of claim 20 wherein the locking rod incorporates a pin and a locking screw which are disposed at approximately 90 degrees to each other wherein when the locking rod is rotated in one direction the pin engages a slot in the channel in which it is located and wherein the locking rod is rotated in the opposite direction the locking screw engages a second slot in the channel in which it is located, so as to secure the locking rod in the channel in which it is located.

22. The panel device of claim 16 wherein the locking rod incorporates a pin and a locking screw which are disposed at approximately 90 degrees to each other wherein when the locking rod is rotated in one direction the pin engages a slot in the channel in which it is located and wherein the locking rod is rotated in the opposite direction the locking screw engages a second slot in the channel in which it is located, so as to secure the locking rod in the channel in which it is located.

23. The panel device of claim 14 wherein the locking rod incorporates a pin which engages a cut in the hollow channel, in which it is positioned and a cam surface which engages the locking lug.

24. The panel device of claim 23 wherein the locking rod incorporates a pin and a locking screw which are disposed at approximately 90 degrees to each other wherein when the locking rod is rotated in one direction the pin engages a slot in the channel in which it is located and wherein the locking rod is rotated in the opposite direction the locking screw engages a second slot in the channel in which it is located, so as to secure the locking rod in the channel in which it is located.

25. The panel device of claim 14 wherein the locking rod incorporates pins and a locking screw which are disposed at approximately 90 degrees to each other wherein when the locking rod is rotated in one direction the pin engages a slot in the channel in which it is located and wherein the locking rod is rotated in the opposite direction the locking screw engages a second slot in the channel in which it is located, so as to secure the locking rod in the channel in which it is located.

26. A panel display device having a plurality of vertical display panels wherein one or more pairs of adjacent vertical panels are attached to each other by a non-racking attachment system which comprises:

a. at least two male locking lugs which are located on the vertical edge of an intermediate elongated member having planar sides which are angularly disposed to each other, b. female apertures which are located on the vertical edges of a display panel opposite said male locking lugs wherein said female apertures are integral with an elongated compartment which is integral with the vertical edge of said display panel.

c. at least one stop block which is located below at least one said female aperture, and are elongated rotatable, a biased lock for securing said male locking lugs into said female apertures, d. a locking rod having a first and second ends the first end being adapted to being gripped and rotated, said second end being adapted to engage the head of an adjacent locking lug, the locking rod being positioned in said elongated compartment of the said display panel.

27. The panel display device of claim 26 wherein the vertical edges of said display panels incorporate elongated channels in which are located, the female apertures and said locking rod.

* * * * *